United States Patent [19]

Levine

[11] 4,281,755

[45] Aug. 4, 1981

[54] REPEATING COIN-OPERATED MECHANISM

[75] Inventor: Stanley D. Levine, Melville, N.Y.

[73] Assignee: U.S. Billiards, Inc., Amityville, N.Y.

[21] Appl. No.: 77,796

[22] Filed: Sep. 24, 1979

[51] Int. Cl.[3] ..... G07F 5/02

[52] U.S. Cl. ..... 194/1 J

[58] Field of Search ..... 194/1 G, 1 J, 92, 55, 194/1 Q, 9 T, 55, 56–59

[56] References Cited

U.S. PATENT DOCUMENTS

| | | | |
|---|---|---|---|
| 2,116,309 | 5/1938 | Gorton | 194/55 X |
| 2,850,135 | 9/1958 | Osborne . | |
| 3,455,427 | 7/1969 | Tinsley, Jr. | 194/55 |
| 3,561,579 | 2/1971 | Allison . | |
| 3,670,860 | 6/1972 | Allison . | |
| 3,990,318 | 11/1976 | Cahoe et al. . | |
| 4,033,442 | 7/1977 | Wirstlin et al. . | |
| 4,122,729 | 10/1978 | Mitchel . | |

*Primary Examiner*—Stanley H. Tollberg

*Attorney, Agent, or Firm*—Amster, Rothstein & Engelberg

[57] ABSTRACT

A coin-operated mechanism for use in association with a machine for enabling the machine to be activated a predetermined number of times for a single deposit of the proper amount of coinage. The invention relates to a latch inhibiting mechanism which prevents the latch mechanism, normally requiring a deposit of the proper amount of coinage in return for a single activation of the machine, from engaging until the machine has been activated the predetermined number of times. A cam, during the initial activation, is moved by a reciprocating rack a predetermined distance for each activation of the machine and prevents the latch mechanism from operating until the machine has been activated the predetermined number of times.

14 Claims, 12 Drawing Figures

18
10
26
16
14
22
20
2
2
12

26
16
24
10
36
14
18
20
29
32
34
38
40
63
31
30
28
66
48
46
54
32
90
70
79
88
91
82
56
80
74
76
58
42
44
72
78
89
68
16

REPEATING COIN-OPERATED MECHANISM

The present invention relates generally to a repeating vending or coin-operated mechanism which is useful in initiating and controlling amusement type devices and other coin-operated machines. More specifically, the present invention relates to a new coin-operated mechanism which provides the user of the device or machine multiple usages of the device or machine for a single initial deposit of coinage.

Coin-operated mechanisms are used in controlling various amusement type games and other devices, e.g., pool or billiard tables, pinball machines, skee-ball games and washing and drying machines.

The coin-operated mechanisms include a stationary housing secured to a side wall of the device or machine intended to be controlled and a reciprocating coin slide having a handle, a coin-receiving slot, a rearwardly, downwardly inclined coin-pushing notch, the rear end of the notch extending below the plane of the coin-receiving slot, positioned axially forwardly of the coin-receiving slot and having its rear end intersecting the front of the coin-receiving slot, and a stop wall which extends perpendicular to the direction of reciprocation of the coin slide and is positioned rearward of the coin-receiving slot. With the proper amount of coinage deposited, the user can manually push the handle of the coin slide inwardly with respect to the housing, the coin-pushing notch pushing the coinage through the mechanism, which will activate the device or mechanism upon the coin slide reaching a predetermined, internally extended position. The coin slide is spring biased outwardly with respect to the housing such that when the handle is released, the coin slide will automatically assume its original or ready-to-use position. The housing is also provided with a spring biased finger which pushes the coinage downwardly through the mechanism during reciprocation of the coin slide and a ratchet mechanism which prevents a partial reciprocation of the coin slide, after coinage has been deposited, from resulting in the loss of an activation or usage of the device or machine.

The coin-operated mechanisms also include a latching mechanism which precludes activation of the machine unless the proper coinage has been deposited into the coin-receiving slot by preventing the coin slide from achieving the predetermined, internally extended position of activation. The latching mechanism comprises a latch mounted in the housing adjacent to the coin slide and rearward of the side wall of the device or machine which includes a latch hook positioned toward the rear of the latching mechanism, pivotable with respect to the housing and spring biased into engagement with the stop wall of the coin slide, and an upwardly protruding latch boss positioned forward of the latch hook and on the upper surface of the latch. With the proper amount of coinage deposited into the coin-receiving slot, manually pushing the handle inwardly with respect to the stationary housing results in the coin-pushing notch pushing the coin against the latch boss which, in turn, pivots the latch hook out of engagement with the stop wall of the coin slide. With the latching mechanism thus disengaged, the coin slide can be moved inwardly to the predetermined, internally extended position of activation. If, however, the proper amount of coinage is not deposited into the coin-receiving slot, then attempted reciprocation of the coin slide to the predetermined, internally extended position of activation will be prevented due to the engagement of the latch hook against the stop wall of the coin slide.

Typically, these coin-operated mechanisms will accept a predetermined amount of money in exchange for providing a single activation of the machine or device. For example, these mechanisms will accept the deposit of a single coin or multiple coins either simultaneously or sequentially prior to the machine being activated for a single use.

In view of the present rate of inflation and in further view of the increased cost of energy, the cost of operating the machines have increased thereby resulting in decreased profits for the owners of the machines. One approach to the solution of this problem has been to inhibit the activation of the machine until two or more sets of coinage are deposited into the coin-operated mechanism. U.S. Pat. No. 3,990,318 describes an accumulating control clutch mechanism which is responsive to one, or more than one, reciprocating movements of the coin slide. The machine or device to which the coin-operating mechanism is connected will not be activated until a plurality of complete sets of coinage are deposited.

U.S. Pat. No. 4,123,729 also discloses an operation initiator or coin-operated mechanism. This mechanism does not activate the machine or device until a predetermined number of reciprocations of the coin-controlled handle are performed. Here, again, each reciprocation of the coin-controlled handle requires a deposit of a complete set of appropriate coinage. Thus, the disclosure in U.S. Pat. No. 4,123,729, as the disclosure in U.S. Pat. No. 3,990,318, requires the users of the machines to deposit a predetermined number of coins or sets of coins sequentially into the coin slide prior to receiving a single play, game or usage of the machine or device.

SUMMARY OF THE INVENTION

The present invention is a completely different approach to solving the problems of increased operating costs and decreased profits. The present invention also utilizes the current trend of circulating coins of increasing denominations in increasing quantities. More specifically, the present invention is a coin-operated mechanism which provides a predetermined number of plays, games or usages of the machine or device in exchange for a single deposit of coinage. Since large denomination coins are currently being circulated in ever increasing quantities, the present invention insures to the user of the machine that he is receiving the same value, i.e., activations of the machine per dollar, even though the user deposits a large denomination coin. For example, utilizing the coin-operated mechanism described herein provides to the user of the machine, for a single deposit of the appropriate amount of coinage, e.g., a silver dollar, a plurality of plays, games or usages on the particular machine. As larger denomination coins are issued and circulated in even greater quantities, more activations of the device can be provided in exchange for the deposit of the larger denomination coins. Thus, the owner of the machine is preserving the same value, i.e., activations of the machine per dollar, to the user.

The increased utility of the present invention over the prior art can also be illustrated by an example. If the owner of the machine desires that players or users of the machine deposit a half-dollar for a single activation of the machine, then, using the prior art mechanisms, two quarters or a single half-dollar must be deposited. A second activation of the machine would again require the deposit of two quarters or a half-dollar. Thus, two activations require the user to have in his possession at least two and possibly four coins. With the present mechanism, however, a single, one-dollar coin (presently being circulated in large quantities) can be deposited in exchange for two activations of the machine or device. Thus, the problems inherent in finding "change" for a dollar are substantially decreased. One coin will now suffice where two or four coins were previously necessary.

An object of the present invention is achieved by inhibiting the operation of the latching mechanism, after the initial deposit of the proper amount of coinage, until the predetermined number of activations, per deposit of a single set of coinage, have been performed.

In accordance with a particular embodiment of the present invention, a coin-operated mechanism includes a stationary housing secured to a side wall of the device intended to be controlled and a coin slide mounted for reciprocal movement with respect to the housing. The coin slide includes a coin-receiving slot, a handle forward of the coin-receiving slot, a downwardly extending coin-pushing notch axially forward of the coin-receiving slot and extending below the plane of the coin-receiving slot and a stop wall, perpendicular to the direction of reciprocation of the coin slide and located rearward of the coin-receiving slot. The coin-receiving slot of the coin slide can be constructed to receive a single large denomination coin or many different denomination coins. The housing is provided with a spring biased finger positioned internally with respect to the side wall of the machine or device for pushing the coinage downwardly through the mechanism during reciprocation of the coin slide and a ratchet mechanism positioned adjacent to one side of the coin slide which prevents a partial reciprocation of the coin slide, after coinage has been deposited, from resulting in the loss of an activation or usage of the device or machine. With the proper amount of coinage deposited in the coin-receiving slot of the coin slide, the user can, by grasping the handle, manually push the coin slide inwardly, with respect to the housing. The coin-pushing notch of the coin slide and the spring biased finger pushes the coinage through the mechanism, such that when the coin slide reaches a predetermined, internally extended position, the machine or device will be activated. The coin slide is spring biased outwardly with respect to the housing such that when the handle is released, the coin slide will automatically reassume its original or ready-to-use position.

The present invention is also provided with a latching mechanism which precludes reciprocation of the coin slide (thereby precluding activation of the machine) unless the proper coinage has been first deposited into the coin-receiving slot. The latching mechanism prevents the coin slide from achieving the predetermined, internally extended position of activation and comprises a latch mounted to one side of the coin slide rearward of the side wall of the machine or device and includes a latch hook positioned at its rear and pivotable with respect to the housing and spring biased into engagement with the stop wall of the coin slide, an upwardly protruding latch boss positioned on the upper surface of the latch forward of the latch hook, and an upwardly extending tab located between the latch hook and the latch boss.

With the proper amount of coinage initially deposited into the coin-receiving slot of the coin slide, manually pushing the handle inwardly with respect to the stationary housing results in the coin-pushing notch of the coin slide pushing and sliding the coinage against the latch boss which, in turn, pivots the latch hook out of engagement with the stop wall of the coin slide. With the latch of the latching mechanism thus disengaged, the coin slide can be reciprocated to reach the predetermined internally extended position of machine activation. After reciprocation, the coin slide will assume its original position, i.e., outwardly extended with respect to the housing, since the coin slide is outwardly spring biased.

If, however, the proper amount of coinage is not initially deposited into the coin-receiving slot, then reciprocation of the coin slide to the predetermined, internally extended position of machine activation will be prevented due to the latch hook of the latching mechanism engaging and abutting against the stop wall of the coin slide.

In carrying out the present invention, there is provided a latch inhibiting mechanism for inhibiting the operation of the latching mechanism until a predetermined number of activations of the device are achieved. The latch inhibiting mechanism includes a one-way clutched, rotatable cam supported upon the housing and located adjacent to the latching mechanism; a pinion gear is mounted on a shaft and coupled to provide rotation of the cam. In the preferred embodiment, the cam is provided with a flat surface and a curved surface. A rack for rotating the pinion gear is mounted to a rack slide such that reciprocation of the rack slide reciprocates the rack which pivots the pinion gear. The rack slide has oblong-shaped slots passing therethrough which are guided and pushed rearwardly with respect to the housing, as the coin slide is reciprocated to its predetermined, internally extended position of machine activation, by pins projecting upwardly from the coin slide and through the slots. The guiding pins will engage the rear end of the slots only if the coin slide is free to reciprocate to its predetermined, internally extended position which occurs when the latching mechanism is prevented from engaging the coin slide. When the coin slide is pushed inwardly a sufficient distance to activate the machine, the projecting pins will engage the rear of the slots pushing the rack slide rearward thereby causing the rack to move rearward. Rearward movement of the rack engages and rotates the pinion gear which, in turn, moves the cam through a predetermined distance, in the preferred embodiment, a portion of a complete rotation.

Prior to the deposit of the proper amount of coinage, the upwardly extending tab of the latching mechanism is located and positioned adjacent to the flat surface of the cam. In this initial position, the latch hook of the latching mechanism, biased inwardly by a latch spring, will, upon attempted reciprocation of the coin slide, abut the stop wall of the coin slide, thus preventing extension of the coin slide to its predetermined, internally extended position of machine activation. Deposit of the proper coinage into the coin slide, when accompanied by pushing the coin slide into the housing, causes the latch hook to pivot away from the stop wall of the coin slide, since coinage in the coin slide pushes against the latch boss. Movement or reciprocation of the coin slide to the predetermined, internally extended position activates the machine. As the coin slide is reciprocated to its position of machine activation, the rack slide attached thereto reciprocates causing the pinion gear to rotate, causing the cam to move a predetermined distance.

In the preferred embodiment, the cam is rotated through a portion of a complete rotation resulting in the curved surface of the cam projecting outwardly, over the edge of the housing, against the force of the latch spring, whereby the upwardly extending tab of the latching mechanism will abut against the surface of the cam preventing, after the handle of the coin slide has assumed its original external position with respect to the housing, the latch hook from resuming its engaging position with the stop wall of the coin slide. Thus, operation of the latching mechanism is inhibited and the machine can now be activated by a second reciprocation of the coin slide without depositing any additional coinage.

A second reciprocation of the coin slide reciprocates the rack slide and rack causing the pinion gear to rotate which, in turn, causes the cam to again rotate, in the same direction as its first partial rotation, through a second portion of a complete rotation. The curved portion of the cam will still project outwardly, over the edge of the housing, and the upwardly extending latch tab will still abut against the surface of the cam, thus preventing, after the handle has again resumed its original position with respect to the housing, the latch hook from resuming its engaging position with respect to the stop wall of the coin slide. Here, again, operation of the latching mechanism is inhibited and the machine can be activated a third time by reciprocation of the coin slide without depositing additional coinage.

The latching mechanism is rendered inoperative until the cam has been turned through a complete 360° rotation, i.e., until the flat surface of the cam has returned to its original position adjacent to the upwardly extending latch tab. Additional activations of the machine would then require deposit of additional coinage.

Thus, the present invention inhibits the normal operation of the latching mechanism until a predetermined number of plays, games or activations of the machine have been used. Inhibiting the operation of the latching mechanism allows the user of the machine to deposit, a single time, the proper coinage and receive, in return, a predetermined number of activations of the machine. Upon depositing the proper coinage and after initial reciprocation of the coin slide, the latching mechanism is rendered inoperative until the coin slide has been reciprocated (each extension of the coin slide to the predetermined, internally extended position providing an activation of the machine) a predetermined number of times. After the coin slide has been reciprocated the predetermined number of times, the latch mechanism will again prevent machine activation until an additional deposit of the proper amount of coinage is made. In this manner, the user is provided with a plurality of games or usages of the machine for a single deposit of coinage.

DESCRIPTION OF THE PREFERRED EMBODIMENT

Figure 1:
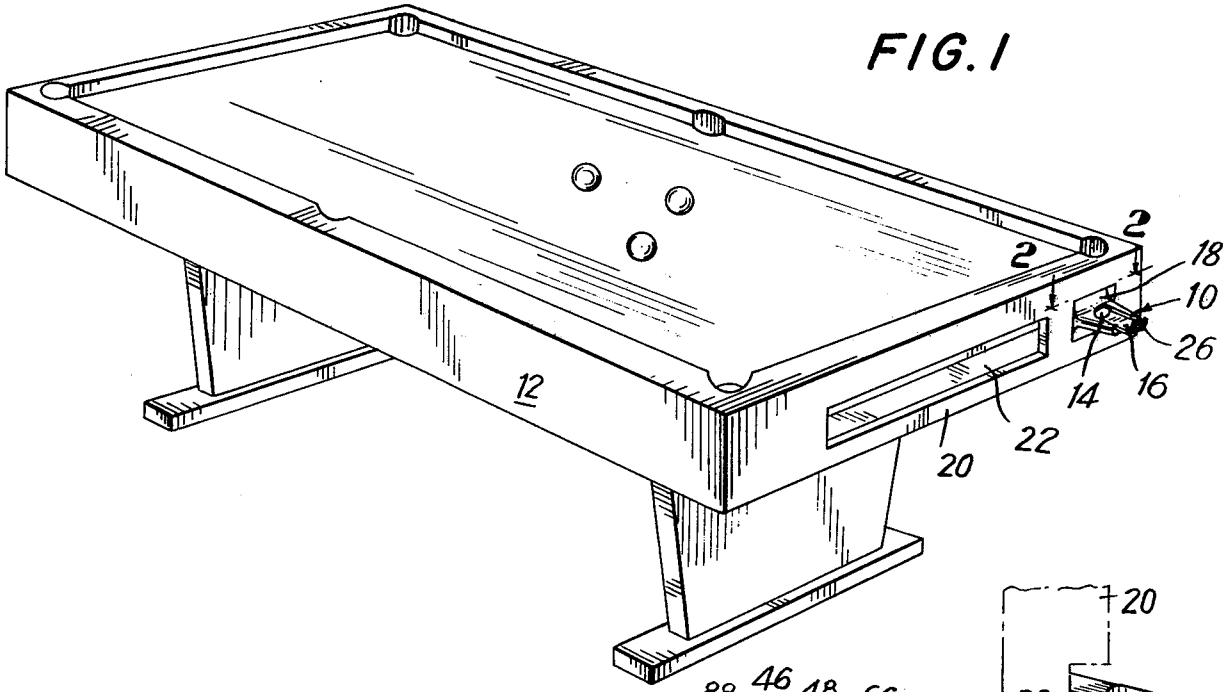
FIG. 1 is a perspective view of a pool table having a prior art coin-operated mechanism shown for regulating and activating the operation of the pool table.

FIG. 1 illustrates a coin-operated mechanism 10 which activates and controls the operation of the pool table 12 in response to the introduction of appropriate coinage into the coin slot 14 of the coin slide 16. Upon introduction of the appropriate coinage into coin slot 14, the coin slide 16 can be pushed inwardly with respect to housing 18 causing activation of the pool table 12 when the coin slide 16 reaches a predetermined, internally extended position of machine activation. In this case, activation of the pool table 12 contemplates that the billiard balls of the pool table will appear at the ball receiving slot 22, allowing the user to play a complete game of pool. It should be appreciated, however, that the coin-operated mechanism 10 is adaptable to be used with many other associated machines or devices which are either electrically or mechanically activated by coin-operated mechanisms. The coin-operated mechanism 10 can be used in conjunction with various machines including, for example, washing and drying machines, pinball machines, gambling devices, and other amusement games. The specific mechanisms for converting the mechanical reciprocation of the coin slide 16 into an activation of the associated machine or device are old in the art and do not constitute a part of this invention.

Figure 2:
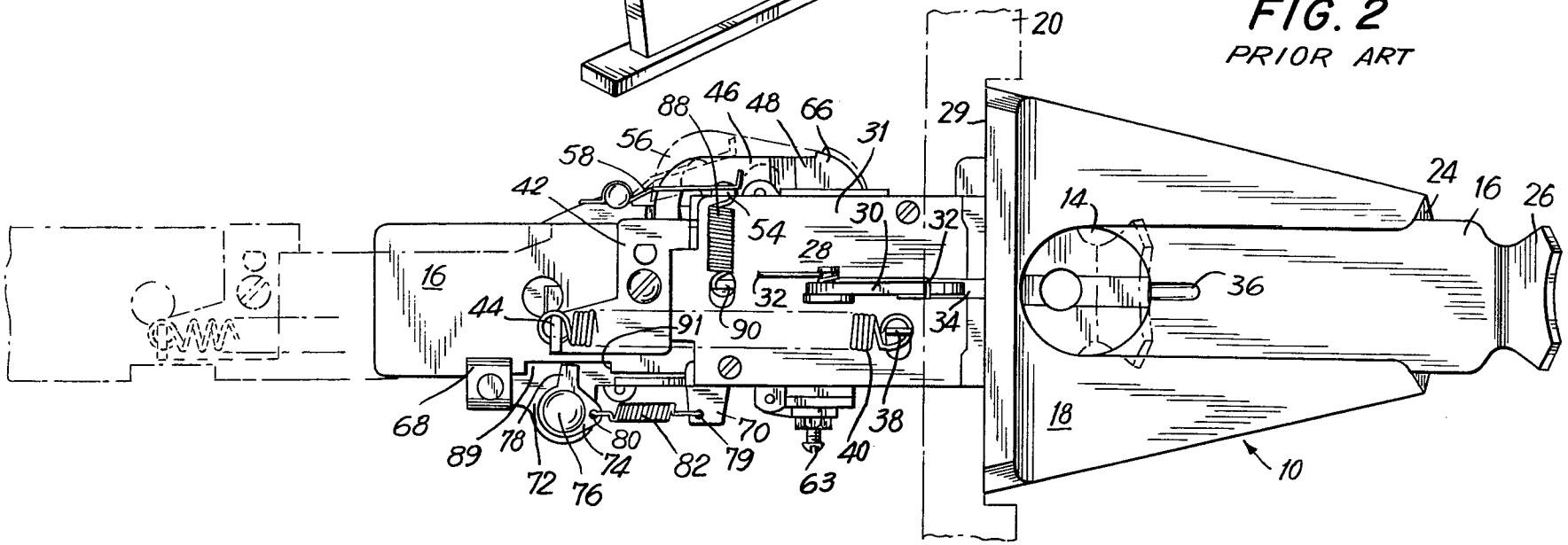
FIG. 2 PRIOR ART
FIG. 2 is a top plan view taken along lines 2—2 of FIG. 1 and shows the prior art coin-operated mechanism with the coin slide in its predetermined, internally extended position of machine activation shown in ghost lines.

Referring to FIG. 2, a coin-operated mechanism 10 comprises a housing 18 which is secured to a sidewall 20 of the pool table 12 or other associated device. The housing 18 is provided with a channel 24 through which the coin slide 16 slides and reciprocates. Coin slide 16 is provided with a handle 26, a coin slot 14 having a diameter substantially equal to the diameter of the coinage intended to be deposited into the coin-operated mechanism 10 in exchange for activations of the pool table 12 or other associated device, and a downwardly inclined, toward the coin slot 14, coin-pushing notch 36 positioned axially of the coin slot 14. The lower edge of the notch 36 is below the plane of the coin slot 14.

The internal structure of coin-operated mechanism 10 will now be described. Stationary slide support 28 is secured to the inside surface 29 of housing 18 and provides a channel or passageway through which coin slide 16 can move and reciprocate. Slide support 28 is provided, on its upper surface 31, with a downwardly, spring-biased finger 30. Spring 32 urges the tip of finger 30 downwardly through slot 34 located in slide support 28 by contacting the upper surface 31 of the slide support 28 on one end and contacting the upper surface of finger 30 on its other end. When a coin is placed in coin slot 14 of the coin slide 16, and handle 26 is pushed inwardly with respect to housing 18, finger 30 will urge the coin down a ramp and onto a flat surface (not shown) whereupon further pushing of the handle 26 causes the coin-pushing notch 36 to push coin 33 rearwardly with respect to housing 18. After the reciprocation of coin slide 16, the coin will pass through a hole located in the bottom of slide support 28 and into the coin collecting box (not shown). As coin slide 16 is reciprocated, by movement of handle 26 inwardly with respect to housing 18, and after the coin has bypassed the tip of finger 30, the tip will travel up the incline of notch 36 against the force of spring 32.

Coin slide 16 is biased outwardly by spring 40 which has one end connected to upwardly extending tab 38 on slide support 28 and its opposite end connected to tab 44 on tab support 42 which is attached to coin slide 16. Spring 40 will be stretched as coin slide 16 is reciprocated to its predetermined, internally extended position of activation and thus provides a positive force to urge coin slide 16 outwardly, with respect to housing 18, to its initial or ready-to-use position.

The coin-operated mechanism also includes a latching mechanism 46, the construction and operation of which will be understood by referring to FIGS. 2, 6 and 9–12. Latching mechanism 46 includes latch 48, pivotable about pivot pin 50 mounted in slide support 28, an upwardly extending latch boss 52, and an upwardly extending tab 54. An inwardly extending latch hook 56 is formed on the forward end of latch 48 and is spring biased toward coin slide 16 by spring 58, secured to one end to slide support 28, the other end pressing against tab 54.

Slide support 28 is also provided with an adjustment screw 63 (see FIGS. 2–4 and 7), the flat end of which abuts against an internal, upwardly extending abutment boss (not shown) located directly opposite to latch boss 52 of latch 48. Adjustment of screw 63 slides the abutment boss toward and away from latch boss 52, as desired, thereby regulating the distance between the two bosses. The distance between latch boss 52 and the abutment boss should be less than the diameter of the coin so that as the coin is pushed between the latch boss and the abutment boss, positive abutment against the abutment boss will cause latch boss 52 to pivot away from the coin slide 16 thereby pivoting latch 48 away from the coin slide 16. As best seen in FIG. 2, latching mechanism 46 is also provided with a spring 88 which facilitates the operation of spring 58 and is secured to one end to upwardly extending tab 90, located on the upper surface of slide support 28, and on its other end is secured around upwardly extending tab 54 of latch 48. Just as spring 58 serves to bias latch hook 56 inwardly with respect to coin slide 16, spring 88 also serves to urge latch hook 56 toward coin slide 16.

Tapering wall 62 (see FIGS. 7 and 12), increasing the width of the coin slide 16 from its width at the position of tab support 42 to a greater width at the position of coin slot 14, facilitates the disengagement of the latching mechanism 46 from the stop wall 64 when proper coinage is deposited. Tapering wall 62 terminates at stop wall 64 which stop wall extends perpendicular to the direction of reciprocation of coin slide 16.

Referring to FIGS. 2–4 and 7, support 28 is provided with retaining flange 68 which overlies and holds coin slide 16 within the slide support 28, an outwardly extending flange 70, having a hole 79, and an outwardly extending ear 72. Ratchet 74, supported by ear 72 and pivotable about pin 76, is provided with hole 80 and a horizontally extending tab element 78 which projects toward coin slide 16. Spring 82 is connected between flange 70 and ratchet 74 by passing through holes 79 and 80, respectively. Spring 82 urges tab element 78 to assume a position perpendicular to the direction of reciprocation of coin slide 16. Coin slide 16 is also provided, on the side opposite to that to tapering wall 62 and stop wall 64, with a row of teeth 86 bounded by cutouts 87 and 89 (see FIG. 7).

Operation of coin-operated mechanism 10 can now be described. With proper coinage 33 deposited into coin slot 14, handle 26 of the coin slide 16 is pushed inwardly with respect to housing 18. Finger 30 urges the coinage 33 down a ramp and onto a flat surface which is at the same vertical position as ear 66 (see FIG. 6) of the latch 48. As the coin slide 16 is continued to be pushed inwardly with respect to housing 18, the coin slide 16, via downwardly inclined coin-pushing notch 36, pushes the coin 33 between the abutment boss and the latch boss 52. Since abutment boss 53 is immobile and latch boss 52 is secured to pivotable latch 48, continued pushing of coin 33 between the bosses causes latch 48 to pivot outwardly, about pivot pin 50, and against the forces of springs 58 and 88. In this manner, the latch hook 56 is disengaged from the stop wall 64 of the coin slide 16, i.e., the latch hook 56 cannot abut stop wall 64, permitting continued inward movement of the coin 33 which causes the coin to fall into a coin collecting box located beneath the slide support 28. With the latch hook 56 prevented from contacting the stop wall 64, coin slide 16 can be extended to its predetermined, internally extended position of machine activation. After the coin slide reaches this position of machine activation, the handle 26 moves outwardly with the aid of spring 40 to return coin slide 16 to its initial position, i.e., the handle 26 located completely beyond channel 24 of housing 18 (see FIG. 3). Additional activations of the machine or pool table 12 will require additional deposits of the proper amount of coinage.

If, however, an individual had attempted to activate the pool table 12 or other associated device by merely reciprocating the coin slide 16, without first depositing the appropriate coinage 33 into coin slot 14, the latching mechanism 46 would prevent coin slide 16 from reaching its predetermined, internally extended position of machine activation since latch hook 56 is urged against the stop wall 64 of the coin slide 16 by springs 58 and 88, unless proper coinage is deposited into the coin slot 14. With the latch hook 56 urged against stop wall 64, the coin slide 16 is prevented from reaching its predetermined, internally extended position of machine activation. If proper coinage is deposited into coin slot 14 and the coin slide 16 is pushed inwardly, then latch 48 will be disengaged from stop wall 64 since the coinage 33 will be pushed between the immobile abutment boss and latch boss 52 which forces latch 48 to pivot away from the stop wall 64 of coin slide 16. Thus, the latching mechanism 46, by preventing the coin slide 16 from being extended to its predetermined, internally extended position of machine activation, prevents the pool table 12 or other associated device from being used unless and until proper coinage has been first deposited into the coin slot 14.

Ratchet 74 prevents a user of the machine from forfeiting an activation of the machine, after depositing the proper amount of coinage 33, merely because the reciprocation of coin slide 16 is inadvertently interrupted. In operation, when the handle 26 of coin slide 16 is pushed inwardly with respect to housing 18, the tab element 78 of the ratchet mechanism will be initially deflected rearwardly by the contact between it and the rear surface 91 (see FIGS. 2, 3 and 7) of cutout 89. Continued rearward pushing of handle 26 of the coin slide 16 causes tab element 78 to ride upon and contact one side of the row of teeth 86 since spring 82 constantly urges tab element 78 back to its position perpendicular to the direction of travel of coin slide 16. If reciprocation of coin slide 16 is interrupted, spring 40 will urge the coin slide 16 to its original position, i.e., handle 26 positioned external to housing 18, however, tab element 78 will prevent the coin slide 16 from returning to its outwardly extended position without the machine being activated since it prevents the coin slide 16 from moving in that direction because tab element 78 will abut against the other side of the row of teeth 86. Thus, the user can resume and continue pushing the handle 26 of coin slide 16 until an activation of the machine is received. Once the coin slide 16 has been pushed inwardly to its predetermined, internally extended position of machine activation, the tab element 78 will fall into cutout 87, urged in that direction by spring 82, thereby disabling tab element 78 and allowing coin slide 16 to assume its original position, aided by contraction of spring 40.

The present invention allows, for a single deposit of the proper amount of coinage, a predetermined number of activations of the pool table 12 or other associated machine or device. This is accomplished by a latch inhibiting mechanism which inhibits the latch hook 56 of the latching mechanism 46 from engaging with stop wall 64 of the coin slide 16, after the initial deposit of the proper amount of coinage, until the coin slide 16 has been reciprocated to its predetermined, internally extended position of machine activation the predetermined number of activations that the mechanism is set to provide in return for each deposit of the proper amount of coinage. The latching mechanism 46 is identical to that previously described with the sole exception that spring 88 is eliminated.

Figure 3:
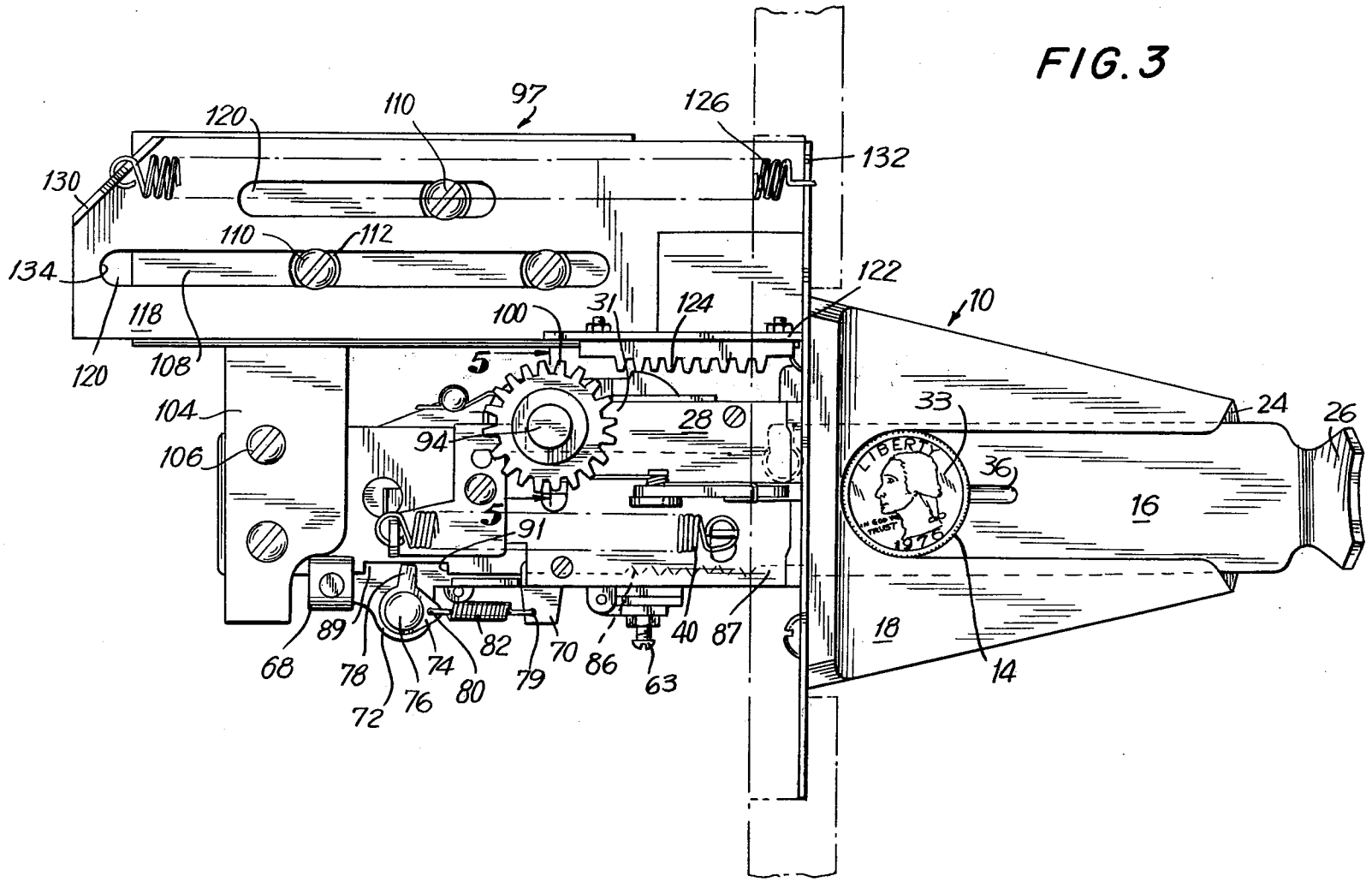
FIG. 3 is a top plan view of the present invention, a coin-operated mechanism, with coinage placed in the coin slot, shown prior to the initial reciprocation of the coin slide.
Figure 4:
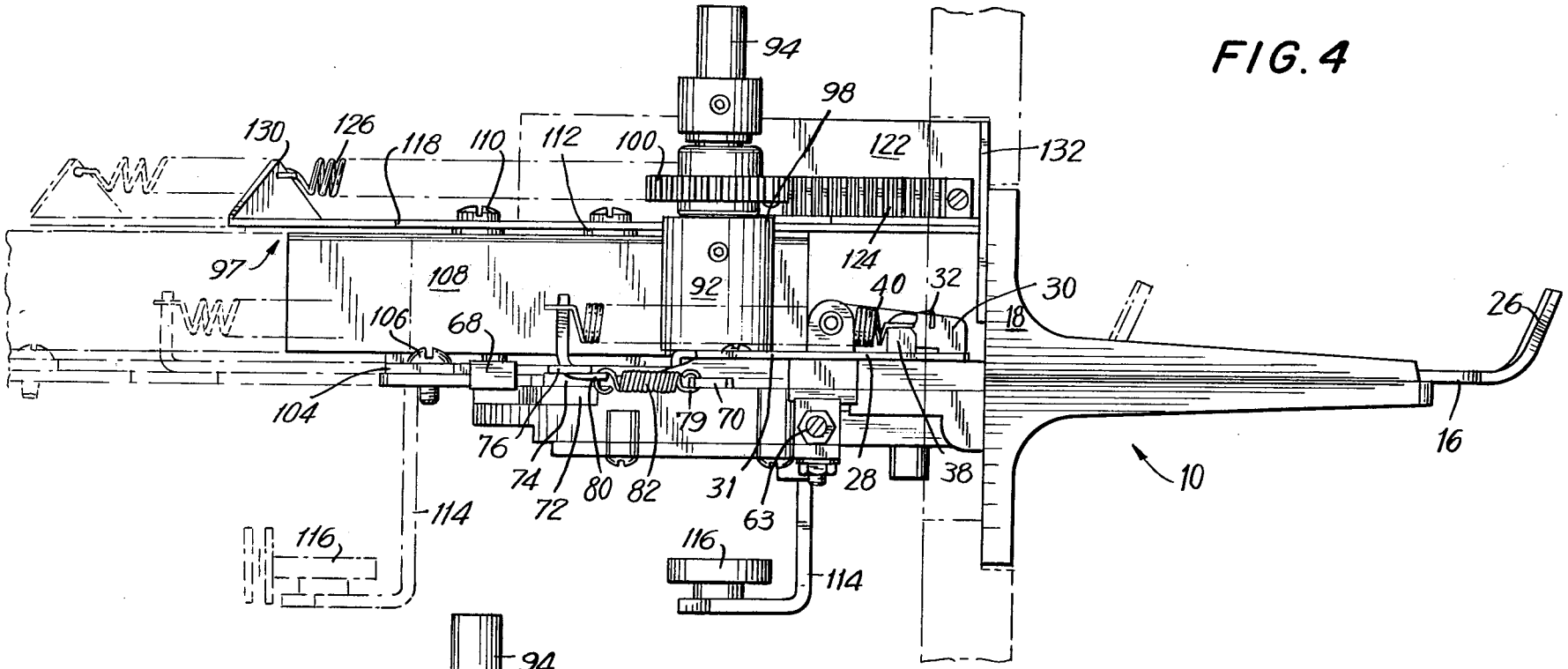
FIG. 4 is a side plan view of the present invention, the solid lines showing the coin-operated mechanism prior to the initial reciprocation of the coin slide, and the ghost lines showing the coin slide in its activating, predetermined, internally extended position.
Figure 6:
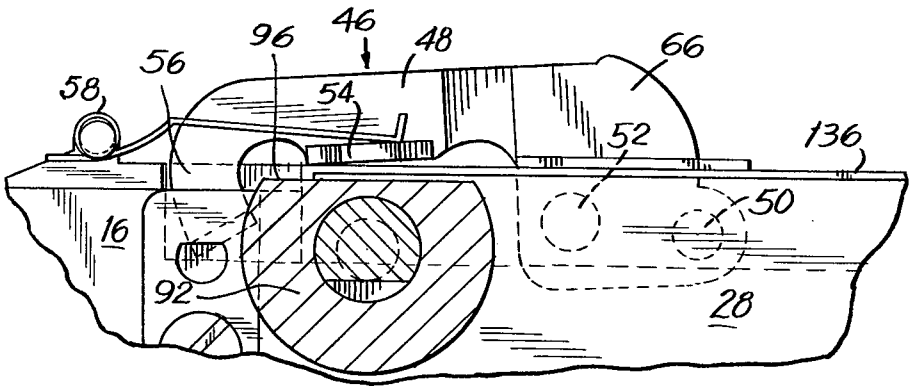
FIG. 6 is a partial cross-sectional view, taken along lines 6—6 of FIG. 5, of the latching mechanism, coin slide and cam, showing the position of the elements before coinage is deposited.
Figure 5:
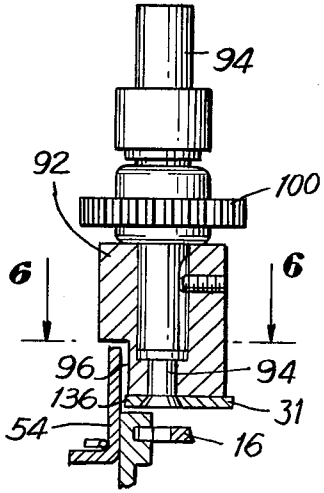
FIG. 5 is a partial cross-sectional and partial rear plan view showing the cam and pinion gear of the latch inhibiting mechanism, the coin slide and the latching mechanism.
Figure 7:
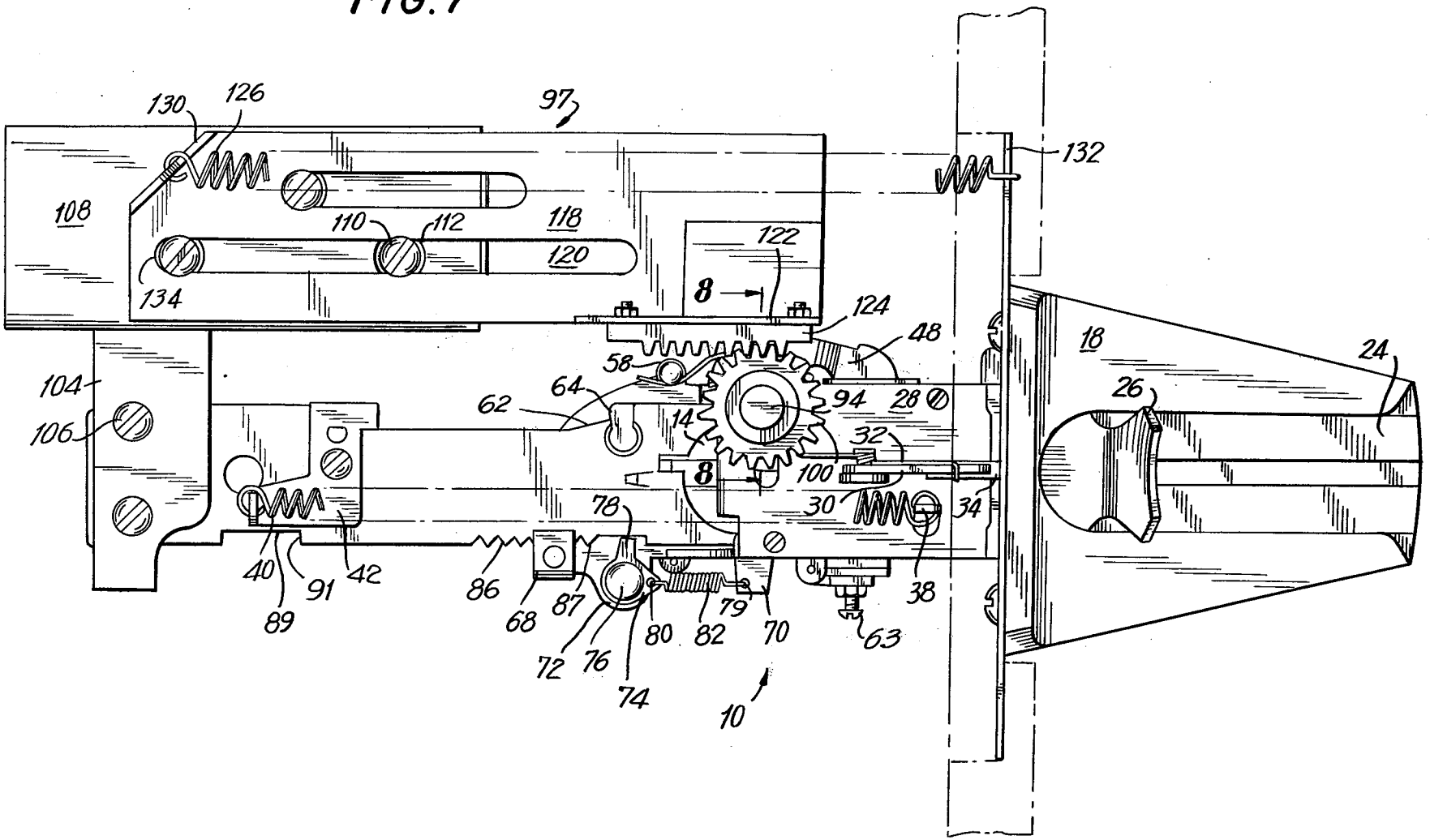
FIG. 7 is a top plan view of the coin-operated mechanism of the present invention, showing the coin slide extended to its activation or predetermined, internally extended position.
Figure 8:
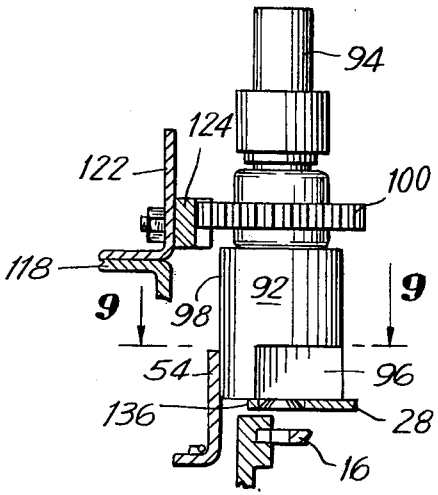
FIG. 8 is a rear plan view of the latching mechanism and the latch inhibiting mechanism, showing the latching mechanism prevented from engaging the coin slide.

The latch inhibiting mechanism will now be described. Referring to FIGS. 3, 4 and 7, slide support 28 is provided, on its upper surface 31, with a one-way clutched cam 92 rotatable about pin 94 (see FIG. 5) which passes through a hole formed in the upper surface 31 of slide support 28. The cam 92 is provided with a flat, cutout surface 96 (see FIG. 8) and a curved surface 98. The cam 92 is positioned on the slide support 28 such that flat surface 96 is initially flush with the outer edge 136 (see FIGS. 5 and 8) of slide support 28 yet, upon rotation of the cam 92, the curved surface 98 will overhang the outer edge 136 of the slide support 28. A pinion gear 100 is mounted on shaft 94 (see FIGS. 4 and 5) on top of cam 92 to rotate cam 92; rotation of pinion gear 100 in a counterclockwise direction, as viewed from the top of the coin-operated mechanism 10, rotates cam 92 in a counterclockwise direction while rotation of pinion gear 100 in a clockwise direction, as viewed from the top of the coin-operated mechanism 10, fails to rotate cam 92.

Referring to FIGS. 3, 4 and 7, support flange 104, secured to coin slide 16 by screws 106, extends horizontally with respect to coin slide 16. A riser 108 is connected to the support flange 104 and is provided, on its top surface, with a plurality of guiding members 110 in the form of screws, the heads of which are spaced above the riser 108 by washers 112. The lower surface of riser 108 is provided with an extension 114 (see FIG. 4) which is itself provided with a rotatable wheel 116, the extension 114 and wheel 116 forming a part of the mechanical or electrical activation linkage for the device. The latch inhibiting mechanism is provided with a travel allowance mechanism 97 which precludes reciprocation of a rack 124 unless the latching mechanism 46 is disengaged from the coin slide 16. A rack slide 118, provided with longitudinally extending slots 120, through which guiding members 110 of riser 108 pass, is provided with a vertically extending flange 122 to which rack 124 is attached. Rack 124 is positioned at the same relative vertical position of pinion gear 100 so as to matingly engage and turn pinion gear 100.

Reciprocation of coin slide 16, by inwardly pushing handle 26, causes the guiding members 110 of riser 108 to travel inwardly with respect to stationary housing 18. Rack slide 118 will, however, not reciprocate until the guiding members 110 abut against the rear edges 134 of the longitudinal slots 120. Rack slide 118 reciprocates in the same direction as coin slide 16. The length and position of slots 120 are such that rack slide 118 will not internally extend, i.e., guiding members 110 will not abut or pull the rear edges 143 of slots 120, until the latching mechanism is disengaged from contact with the stop wall 64 of the coin slide 16. Thus, the relative length and position of the longitudinal slots with respect to the distance between the initial position of stop wall 64 and the latch hook 56 provide a mechanism which prohibits the rack slide 118 and rack 124 from reciprocating until the latching mechanism has first been disengaged. Thus, the rack 124 will not cause the pinion gear 100 to rotate unless the coin slide 16 is capable of reaching its predetermined, internally extended position. A spring 126, secured on one end to wall 132 of housing 18 and secured on its other end to upwardly turned ear 130 of rack slide 118, urges the rack slide 118 and rack 124 back to their original positions.

Operation of the coin-operated mechanism 10 can now be fully described. FIG. 3 shows the coin-operated device in its ready-to-use position. If the proper amount of coinage is not deposited into coin slot 14 of coin slide 16 then, when the handle 26 is pushed inwardly with respect to housing 18, the latch hook 56 will abut against stop wall 64 of coin slide 16, since the hook 56 is spring biased inwardly by spring 58 (see FIG. 12) thereby preventing the coin slide 16 from reaching its predetermined, internally extended position of machine activation. Thus, while the coin slide 14 can be partially reciprocated, the engagement of the latching mechanism 46 with stop wall 64 prevents the machine from being activated. It can be seen, therefore, that prior to the initial deposit of the proper amount of coinage, the latching mechanism 46 is fully operational, i.e., the latch hook 56 engages the stop wall 64 of coin slide 16 and thereby prevents continued inward pushing of the coin slide 16.

If, however, proper coinage is deposited within coin slot 14 of coin slide 16, then finger 30 will push coin 33 down, coin-pushing notch 36 will push coin 33 between the immobile abutment boss and latch boss 52 and upon further inward pushing of the coin slide 16, the coin 33 will outwardly, with respect to coin slide 16, push upon latch boss 52 which will cause the latch 48 to pivot about pivot pin 50 causing latch hook 56 to rotate out of engagement with the stop wall 64 of the coin slide 16. Thus, the coin slide is allowed to achieve its position of machine activation, i.e., its predetermined, internally extended position with respect to housing 18. With the hook 56 out of engagement with stop wall 64, the coin slide 16 can fully reciprocate. The ratchet 74 performs in the same manner as previously described.

As the coin slide 16 is pushed inwardly with respect to housing 18, support flange 104, riser 108 and extension 114, connected to coin slide 16, are also pushed to their predetermined, internally extended positions. With the latching mechanism disengaged, the guiding members 110 will pull the rack slide 118 and the rack 124 inwardly, rack 124 engaging and rotating pinion gear 100. Due to the relative length of rack 124 with respect to the circumference of pinion gear 100, reciprocation of rack 124 will not rotate pinion gear 100 through a complete 360° rotation but rather will rotate it through a portion of a complete rotation, in the preferred embodiment, one-third of a complete rotation or 120°. Rotation of pinion gear 100 in a counterclockwise direction, as viewed from the top, causes the cam 92, supported on slide support 28, to rotate, in the same direction, through a corresponding portion of a complete 360° rotation.

After the initial inward push of handle 26, activating the pool table 12 or other device, the handle 26 is released whereupon springs 126 and 40 will cause the rack slide 118, rack 124, riser 108, coin slide 16 and handle 26 to return to their original positions. As the rack slide 118 and rack 124 reciprocate back to their original positions, pinion gear 100 will be rotated, in a clockwise direction, as viewed from the top, yet since cam 92 is one-way clutched, it will not rotate back to its original position. Thus, cam 92 will, after a single complete reciprocation of coin slide 16, have been rotated through a portion of a complete rotation, i.e., 120°.

With cam 92 rotated through a portion of a complete rotation, the curved surface 98 of cam 92 overhangs the edge 136 of slide support 28 and abuts against upwardly extending tab 54 of latch 48.

Figure 9:
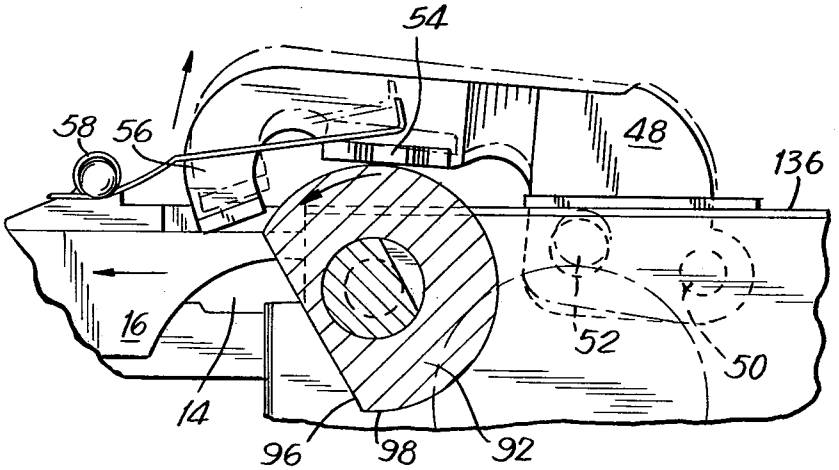
FIG. 9 is a partial cross-sectional view, taken along lines 9—9 of FIG. 8, showing the latching mechanism, cam, and coin slide in position when the coin slide is initially extended to its predetermined, internally extended position after a deposit of coinage.

Thus, the latching mechanism is rendered inoperative, i.e., the latch hook 56 is prevented from engaging the stop wall 64 of the coin slide 16. The coin slide 16 with its stop wall 64 can reciprocate past the latch hook 56 since the latch hook 56 is now pushed away from the coin slide by the curved surface 98 of the cam 92. The relative positions of the flat surface 96 of cam 92, latch hook 56 and upwardly extending tab 54, after the coin slide 16 has been fully reciprocated a single time to its predetermined, internally extended position of machine activation, is shown in FIG. 9. It can be clearly seen that the flat surface 96 of the cam 92 has been rotated 120° from its original position.

Figure 10:
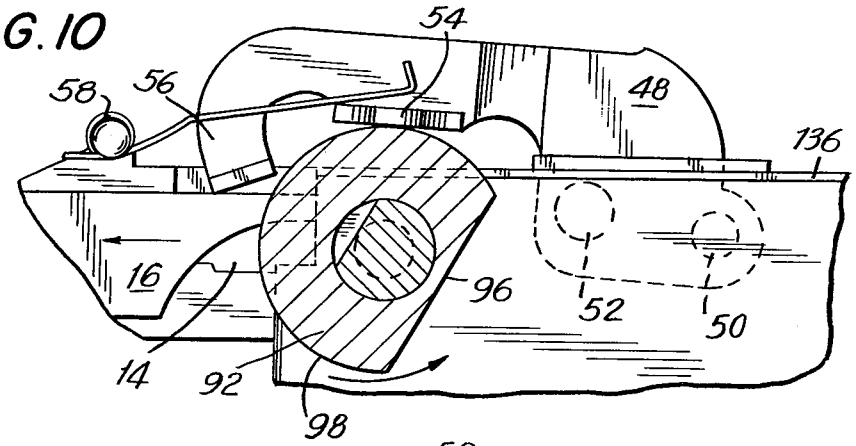
FIG. 10 is the same view as FIG. 9, but showing the elements after the coin slide has been extended to its predetermined, internally extended position a second time.

With the latching mechanism 46 thus rendered inoperative, a second full reciprocation of coin slide 16 can be performed without the necessity of depositing an additional amount of coinage. The second reciprocation of coin slide 16 to its predetermined, internally extended position activates the machine or associated device a second time. Pushing the handle 26 inwardly with respect to housing 18 again causes the coin slide 16, the support flange 104, the riser 108, the rack slide 118 and the rack 124 to reciprocate to reach their predetermined, internally extended positions of machine activation. Here, again, reciprocation of the rack 124 causes the pinion gear 100 to first rotate counterclockwise, thereby rotating the cam 92 through a second portion of a complete rotation, and then, upon the coin slide 16 and sliding rack 118 resuming their original positions, rotate clockwise, as viewed from the top. Cam 92 will, however, only rotate counterclockwise through a portion of a complete rotation, i.e., a second, one-third of a complete rotation. Again, the curved surface 98 of the cam 92 will abut the upwardly extending tab 54 of the latch 48 and prevent the latch hook 56 from engaging the stop surface 64 of the coin slide 16. Inhibiting engagement between the latch hook 56 and the stop surface 64 of coin slide 16 allows the coin slide to be reciprocated without depositing any coinage to its predetermined, internally extended position, and thereby activate the machine or device a third time. FIG. 10 illustrates the relative positions of the flat surface 96 of cam 92, latch 48, latch hook 56, stop surface 64 and coin slide 16 after the coin slide 16 has been fully reciprocated a second time. It can be there seen that the flat surface 96 has been rotated another 120° from its orientation which it assumed after the first complete reciprocation of the coin slide 16, i.e., 240° from its original orientation prior to any reciprocation of coin slide 16.

Figure 12:
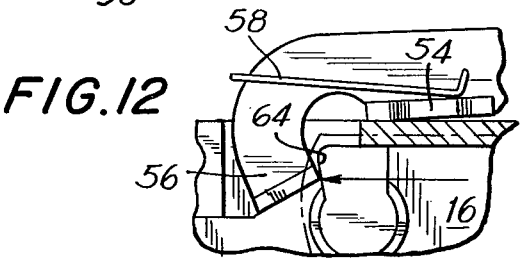
FIG. 12 is a partial cross-sectional view of the latch hook and stop wall of the coin slide, showing the position of the elements if the coin slide is attempted to be reciprocated without the initial deposit of coinage.
Figure 11:
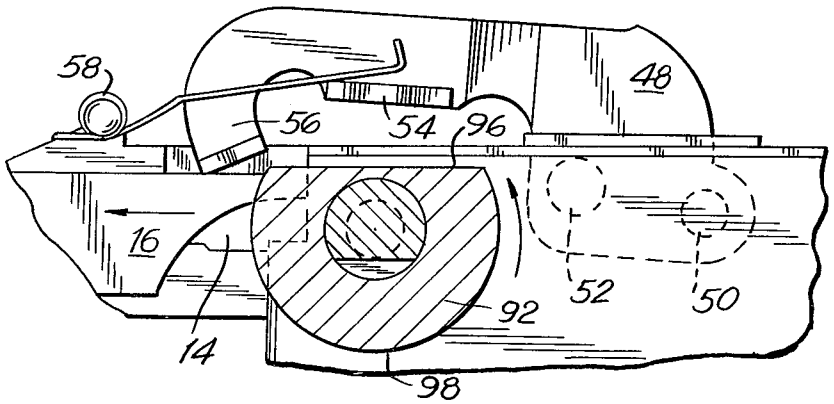
FIG. 11 is the same view as FIG. 9 and FIG. 10, but showing the elements after the coin slide has been extended to its predetermined, internally extending position of machine activation a third time.

Since the latching mechanism 46 is still rendered inoperative, by the abutment of the curved surface 98 against upwardly extending tab 54, a third reciprocation (resulting in a third activation of the machine or device) of coin slide 16 can be performed. Again, the coin slide 16 can be reciprocated and extended through housing 18 so that it, flange 104, riser 106, rack slide 118 and rack 124 reach their predetermined, internally extended position of machine activation. Again, reciprocal movement of rack 124 causes rotation of pinion gear 100 which causes cam 92 to rotate through a third and final 120° portion of a complete rotation. This third full coin slide reciprocation results in flat surface 96 of cam 92 being located adjacent to or in juxtaposition with the upwardly extending tab 54 of the latch 48. Since latch 48 is spring biased toward coin slide 16, by spring 58, the latch hook 56 will pivot, about pivot pin 50, back into engagement with stop wall 64, i.e., if coin slide 16 is attempted to be fully reciprocated a fourth time prior to depositing an additional amount of proper coinage, the hook 56 will abut against stop wall 64 and thus prevent an activation of the machine. Thus, after the pool table 12, machine or associated device, has been activated three times for a single deposit of the proper amount of coinage, a fourth activation of the device will be prevented by the now engaging latch mechanism, unless the user deposits a new set of the proper amount of coinage. FIG. 11 shows the relative positions of the flat surface 96 of cam 92, latch 48, upwardly extending tab 54 and coin slide 16 immediately prior to latch hook 56 engaging stop wall 64. FIG. 12 shows the flat surface 96 of cam 92, adjacent to or in juxtaposition with upwardly extending tab 54 of latch 48 and shows the positive engagement between latch hook 56 and stop wall 64 if and when the coin slide 16 is attempted to be reciprocated prior to the deposit of the proper amount of coinage. It should be easily understood by those skilled in the art that by modifying the cam, the longitudinal slots, the length of the rack, etc., the owner can alter the number of activations received for each deposit of coinage. The normally operative latching mechanism, which prevents the machine or device from being activated unless and until the proper amount of coinage is deposited, is rendered inoperative by the latch inhibiting mechanism by preventing the latch hook from engaging the stop wall of the coin slide until the user has received the predetermined number of machine activations in exchange for the single deposit of coinage.

As will be readily apparent to those skilled in the art, the present invention may be realized in other specific forms without departing from its spirit or essential characteristics. The present embodiment is, therefore, to be considered as illustrative and not descriptive, the scope of the invention being indicated by the claims rather than by the foregoing descriptions, and all changes which come within the meaning and range of equivalents of the claims are therefore intended to be embrace therein.

I claim:

1. A coin-operated mechanism for use in association with a device to enable said device to be activated a predetermined number of times, at least twice, in response to a deposit of a predetermined amount of coinage, said coin-operated mechanism comprising a housing, a coin slide mounted for reciprocal inward and outward movement relative to said housing and arranged to activate said device upon reaching a predetermined, internally extended position with respect to said housing, a latching mechanism mounted in said housing to engage said coin slide and prevent said coin slide from reaching said predetermined, internally extended position unless proper coinage is deposited into said coin slide and latch inhibiting means arranged in said housing for preventing said latching mechanism from engaging said coin slide after the initial deposite of coinage and inward movement of said coin slide to said predetermined, internally extended position, said latching mechanism being prevented from engaging the coin slide until said coin slide has been reciprocated said predetermined number of times.

2. A coin-operated mechanism as claimed in claim 1 wherein said latch inhibiting means includes a cam and cam moving means mounted for movement in response to reciprocating movement of said coin slide for moving said cam a predetermined distance for each reciprocation of said coin slide to said predetermined, internally extended position, said latching mechanism including a latch positioned in said housing and riding on the surface of said cam, said cam, after the initial reciprocation of said coin slide, preventing said latch from engaging said coin slide until said coin slide has been reciprocated said predetermined number of times.

3. A coin-operated mechanism as claimed claim 2 wherein said cam is rotatable and includes a flat surface, juxtaposition of said flat surface and said latch allowing said latch to engage said coin slide and preventing said coin slide from reaching said predetermined, internally extended position.

4. A coin-operated mechanism as claimed in claim 3 wherein said cam is also provided with a curved surface, abutment between said curved surface and said latch preventing said latch from engaging said coin slide until said coin slide has been reciprocated said predetermined number of times.

5. A coin-operated mechanism as claimed in claim 4 wherein said predetermined distance is a portion of a complete rotation.

6. A coin-operated mechanism as claimed in claim 2 wherein said cam moving means includes a pinion gear for moving said cam said predetermined distance for each reciprocation of said coin slide to said predetermined, internally extended position and a reciprocating rack mounted in said housing and arranged to rotate said pinion gear as said coin slide is pushed inwardly toward said predetermined, internally extended position.

7. A coin-operated mechanism as claimed in claim 6 wherein said coin slide is provided with travel allowance means for reciprocating said rack only when said coin slide is not engaged by said latching mechanism.

8. A coin-operated mechanism as claimed in claim 7 wherein said rack is mounted on a rack slide which reciprocates inward and outward with respect to said housing and said travel allowance means including guiding pins mounted to said coin slide and passing through at least one slot located on said rack slide, said rack slide being pushed inwardly by said guiding pins abutting against the edge of said slots when said coin slide is reciprocated to said predetermined, internally extended position.

9. A coin-operated mechanism as claimed in claim 8 wherein said rack is outwardly spring biased with respect to said housing.

10. A coin-operated mechanism as claimed in claims 2 or 3 wherein said predetermined distance corresponds inversely to said predetermined number of activations.

11. A coin-operated mechanism for use in association with a device to enable said device to be activated a predetermined number of times, at least twice, in response to an initial deposit of a predetermined amount of coinage, said coin-operated mechanism comprising A. a housing;

B. a coin slide mounted for reciprocal inward and outward movement relative to said housing and arranged to activate said device upon reaching a predetermined, internally extended position with respect to said housing;

C. a latching mechanism mounted in said housing to engage said coin slide and prevent said coin slide from reaching said predetermined, internally extended position unless proper coinage is deposited into said coin slide; and D. a latch inhibiting mechanism arranged in said housing for inhibiting the operation of the latching mechanism until a predetermined number of activations for the device are achieved, which latch inhibiting mechanism includes 1. a one-way clutched rotatable cam supported upon the housing and located adjacent to the latching mechanism, which cam is provided with a flat surface and a curved surface;
2. a pinion gear mounted on a shaft and couples to provide rotation of the cam for a predetermined distance inversely proportional to the number of activations;
3. a rack slide with oblong-shaped slots passing therethrough;
4. guiding pins projecting upwardly from the coin slide and through the slots, which pins engage the rear end of the slots only if the coin slide is free to reciprocate to its predetermined internally extended position (which occurs when the latching mechanism is prevented from engaging the coin slide) so that when the coin slide is pushed inwardly a sufficient distance to activate the device, the pins engage the rear of the slots, pushing the rack slide rearward; and
5. a rack mounted to the rack slide for rotating the pinion gear such that reciprocation of the rack slide reciprocates the rack, which pivots the pinion gear, so that rearward movement of the rack engages and rotates the pinion gear which, in turn, moves the cam through a portion of a complete rotation.

12. A coin-operated mechanism for use in association with a device to enable said device to be activated a predetermined number of times, at least twice, in response to an initial deposit of a predetermined amount of coinage, said coin-operated mechanism comprising A. a housing;

B. a coin slide mounted for reciprocal inward and outward movement relative to said housing and arranged to activate said device upon reaching a predetermined, internally extended position with respect to said housing;

C. a latching mechanism mounted in said housing for preventing the coin slide from achieving the predetermined internally extending rearward position of activation, thereby precluding activation of the machine, unless the proper coinage has first been deposited in the coin receiving slot, which latching mechanism includes 1. a latch mounted to one side of the coin slide along the path of movement of the coin slide;
2. a latch hook pivotable with respect to the housing and spring biased into engagement with the stop wall of the coin slide;
3. an outwardly protruding latch boss positioned on the upper surface of the latch forward of the hatch hook; and
4. an upwardly extending tab located between the latch hook and the latch boss; and D. a latch inhibiting mechanism arranged in said housing for inhibiting the operation of the latching mechanism until a predetermined number of activations for the device are achieved, which latch inhibiting mechanism includes 1. a one-way clutched rotatable cam supported upon the housing and located adjacent to the latching mechanism, which cam is provided with a flat surface and a curved surface;
2. a pinion gear mounted on a shaft and coupled to provide rotation of the cam for a predetermined distance inversely proportional to the number of activations;
3. a rack slide with oblong-shaped slots passing therethrough;
4. guiding pins projecting upwardly from the coin slide and through the slots, which pins engage the rear end of the slots only if the coin slide is free to reciprocate to its predetermined internally extended position (which occurs when the latching mechanism is prevented from engaging the coin slide) so that when the coin slide is pushed inwardly a sufficient distance to activate the device, the pins engage the rear of the slots, pushing the rack slide rearward; and
5. a rack mounted to the rack slide for rotating the pinion gear such that reciprocation of the rack slide reciprocates the rack, which pivots the pinion gear, so that rearward movement of the rack engages and rotates the pinion gear which, in turn, moves the cam through a portion of a complete rotation.

13. A coin-operated mechanism to enable a device to be activated a predetermined number of times, at least twice, comprising A. a stationary housing secured to the device intended to be controlled;

B. a coin slide mounted for reciprocal movement with respect to the housing such that when the coin slide reaches a predetermined internally extended rearward position, the device will be activated, which coin slide includes 1. a coin-receiving slot;
2. a handle forward of the coin-receiving slot;
3. a downwardly extending coin-pushing notch forward of the coin-receiving slot extending below the plane of the coin-receiving slot; and
4. a stop wall, perpendicular to the direction of reciprocation of the coin slide and located rearward of the coin-receiving slot;

which coin slide is spring biased outwardly with respect to the housing such that when the handle is released, the coin slide will resume automatically its original externally extended forward position;

C. a spring biased finger positioned internally with respect to the device for pushing the coinage downwardly through the mechanism during reciprocation of the coin slide;

D. a ratchet mechanism positioned adjacent to one side of the coin slide for preventing a partial reciprocation of the coin slide, after coinage has been deposited, from resulting in the loss of a activation or usage of the device;

E. a latching mechanism mounted in said housing for preventing the coin slide from achieving the predetermined internally extending rearward position of activiation, thereby precluding activation of the machine, unless the proper coinage has first been deposited in the coin-receiving slot, which latching mechanism includes 1. a latch mounted to one side of the coin slide along the path of movement of the coin slide;
2. a latch hook pivotable with respect to the housing and spring biased into engagement with the stop wall of the coin slide;
3. an outwardly protruding latch boss positioned on the upper surface of the latch forward of the latch hook; and 4. an upwardly extending tab located between the latch hook and the latch boss; and F. a latch inhibiting mechanism arranged in said housing for inhibiting the operation of the latching mechanism until a predetermined number of activations for the device are achieved, which latch inhibiting mechanism includes 1. a one-way clutched rotatable cam supported upon the housing and located adjacent to the latching mechanism, which cam is provided with a flat surface and a curved surface;
2. a pinion gear mounted on a shaft and coupled to provide rotation of the cam for a predetermined distance inversely proportional to the number of activations;
3. a rack slide with oblong-shaped slots passing therethrough;
4. guiding pins projecting upwardly from the coin slide and through the slots, which pins engage the rear end of the slots only if the coin slide is free to reciprocate to its predetermined internally extended position (which occurs when the latching mechanism is prevented from engaging the coin slide) so that when the coin slide is pushed inwardly a sufficient distance to activate the device, the pins engage the rear of the slots, pushing the rack slide rearward; and
5. a rack mounted to the rack slide for rotating the pinion gear such that reciprocation of the rack slide reciprocates the rack, which pivots the pinion gear, so that rearward movement of the rack engages and rotates the pinion gear which, in turn, moves the cam through a portion of a complete rotation.

14. A device to be activated a predetermined number of times, at least twice, in response to an initial deposit of a predetermined amount of coinage, comprising a supporting structure and a coin-operated mechanism secured to the supporting structure and arranged to activate the device, said coin-operated mechanism including:

A. a housing;

B. a coin slide mounted for reciprocal inward and outward movement relative to said housing and arranged to activate said device upon reaching a predetermined, internally extended position with respect to said housing;

C. a latching mechanism mounted in said housing to engage said coin slide and prevent said coin slide from reaching said predetermined, internally extended position unless proper coinage is deposited into said coin slide; and D. latch inhibiting means arranged in said housing for preventing said latching mechanism from engaging said coin slide after the initial deposit of coinage and inward movement of said coin slide to said predetermined, internally extending position, said latching mechanism being prevented from engaging the coin slide until said coin slide has been reciprocated said predetermined number of times, which device can thereby be activated by the initial deposit of coinage and each reciprocation of said coin slide without a further deposit of coinage for said predetermined number of times.

* * * * *